US005085058A

United States Patent [19]

Aaron et al.

[11] Patent Number: 5,085,058

[45] Date of Patent: Feb. 4, 1992

[54] BI-FLOW EXPANSION DEVICE

[75] Inventors: David A. Aaron, Reisterstown; Piotr A. Domanski, Potomac, both of Md.

[73] Assignee: The United States of America as represented by the Secretary of Commerce, Washington, D.C.

[21] Appl. No.: 553,831

[22] Filed: Jul. 18, 1990

[51] Int. Cl.[5] ..... F25B 13/00

[52] U.S. Cl. ..... 62/324.6; 62/511; 138/44

[58] Field of Search ..... 62/324.6, 324.1, 528, 62/222, 511; 138/44

[56] References Cited

U.S. PATENT DOCUMENTS 2,694,296 11/1954 Prosek et al. ..... 138/44

3,444,699 5/1969 Hannish ..... 62/225

4,311,020 1/1982 Tobin et al. ..... 62/324.6

4,429,552 2/1984 Reedy ..... 62/528

4,548,047 10/1985 Hayashi et al. ..... 62/160

*Primary Examiner*—Albert J. Makay

*Assistant Examiner*—John Sollecito

*Attorney, Agent, or Firm*—Dean E. Carlson

[57] ABSTRACT

A bi-flow expansion device for a heat pump or other apparatus where fluid travel is reversed with different required flow rates in each direction. The device comprises a tubular member mounted in a refrigerant line and having non-symmetrical entrance-exits at the ends of the tubular member for changing the mass flow rate of refrigerant through the expansion device when the direction of refrigerant flow is changed.

6 Claims, 4 Drawing Sheets

BI-FLOW EXPANSION DEVICE

The present invention relates to vapor compression cycle machines, commonly known as heat pumps, and more particularly, to expansion devices for heat pumps.

BACKGROUND OF THE INVENTION

A heat pump is a device for moving heat from a low temperature reservoir to a high temperature reservoir. A heat pump which may be used to heat or cool an indoor space by pumping a refrigerant around a closed loop, includes a compressor, indoor and outdoor heat exchange coils, refrigeration piping, a refrigerant flow reversing valve and expansion devices and check valves. The change from the cooling function to the heating function, and vice versa, is achieved by reversing the direction of refrigerant flow in the system. Because the design mass flow rate for the cooling mode may be from 10% to 80% greater than for the heating mode, two expansion devices having different sizes are used in a typical heat pump system. In each mode, the refrigerant bypasses that expansion device which is to be passive and is metered through the active expansion device.

An expansion device which is capable of combining the functions of both expansion devices and associated check valves could result in reduced costs of hardware and installation, as well as operational advantages, and attempts have been made in the prior art to replace the two expansion devices with one. However, the known resulting devices have been both expensive and complex.

For example, U.S. Pat. No. 3,444,699 to Harnish is concerned with a heat pump in which a single expansion valve is used which responds to the rate of flow of refrigerant liquid by taking advantage of the cooling effect of the liquid to activate a valve piston towards either a more closed or more open position. U.S. Pat. No. 4,548,047 to Hayashi et al is concerned with a short tube restrictor as an expansion device in which a plunger opens and closes valve ports for changing the rate of refrigerant flow.

These and other known expansion devices increase the complexity of heat pumps instead of simplifying them.

SUMMARY OF THE INVENTION

It is accordingly an object of the present invention to provide a bi-flow expansion device for a heat pump which will satisfy refrigerant design flow rates for both the cooling and heating cycles.

In accordance with the present invention, there is provided a bi-flow expansion device for a heat pump system in which the direction of refrigerant flow is reversed when changing from a cooling mode to a heating mode. The bi-flow expansion device comprises a tubular member defining a geometric configuration for changing the rate of flow therethrough when the direction of flow of refrigerant is reversed. The geometric configurations which accomplish the change of flow rate upon change of flow direction are simple yet effective.

DETAILED DESCRIPTION OF THE INVENTION

Figure 1A:
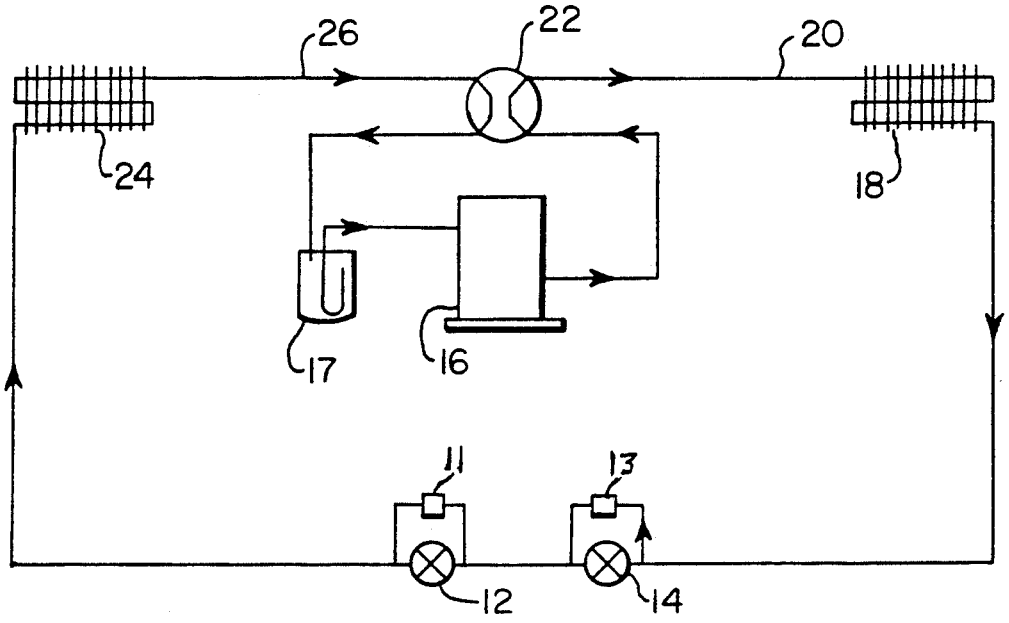
FIG. 1*a* is a diagrammatic view of a prior art heat pump in a cooling mode.
Figure 1B:
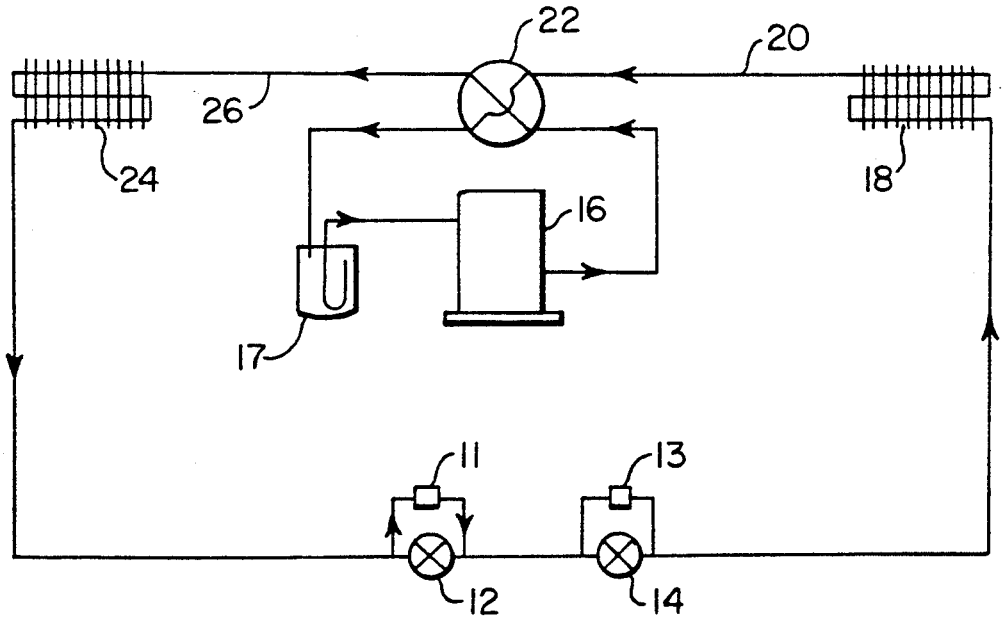
FIG. 1*b* is a diagrammatic view of the heat pump of FIG. 1*a* in a heating mode.

Referring to the drawings, FIGS. 1*a* and 1*b* show schematically the main components of a prior art heat pump, including expansion devices 12, 14 having check valves 11, 13, respectively. The compressor 16 pumps refrigerant either to an outdoor coil 18 through vapor line 20, as dictated by 4-way valve 22 (FIG. 1*a*), or to indoor coil 24 through vapor line 26 (FIG. 1*b*). Refrigerant returns to compressor 16 through accumulator 17. Valve 22 enables the heat pump to switch the modes of operation by reversing the flow of refrigerant in the system.

Figure 2:
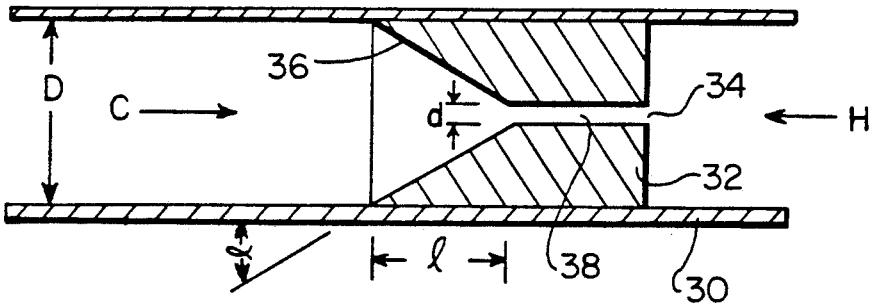
FIG. 2 is a vertical sectional view of one embodiment of the present invention.

The present invention is an expansion device to replace the two expansion devices 12, 14 and their associated check valves 11, 13. In the present invention, different flow restrictions for opposite flow directions are obtained by a non-symmetrical design of the refrigerant passage from one side of the expansion device to the other side. In one embodiment of the present invention, as shown in FIG. 2, short tube restrictor 32 is mounted in refrigerant line 30, having an inner diameter D. Restrictor 32 has an axially-aligned narrow passage 38 having a diameter d, a sharp-edged entrance 34 at one end, and a chamfered entrance at the other end having a chamfer depth l and a conical surface 36 intersecting the wall of refrigerant line 30 at an angle $\alpha$.

This embodiment of the restrictor utilizes the fact that refrigerant mass flow rate through a short-tube restrictor is highly sensitive to the diameter and geometry of the inlet and is very weakly dependent on geometry of the outlet and the tube length. Since changing the heat pump operation from one mode to another is associated with the change of the direction of refrigerant flow, a single bi-flow short tube can serve as an expansion device for both modes if a less obstructive opening faces the direction from which the refrigerant is flowing in the cooling mode, where a higher design mass flow is required In the embodiment shown in FIG. 2, refrigerant entering sharp-edged entrance 34 from the direction H may have about 35% less flow than when the fluid flows in an opposite direction C.

Figure 8:
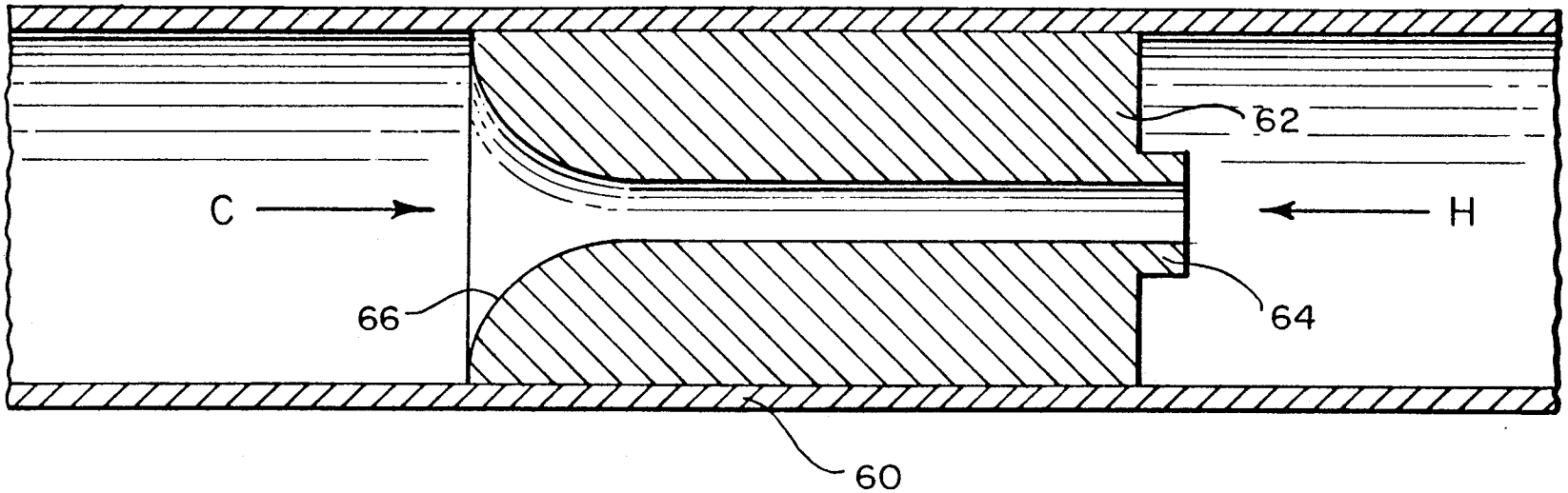
FIG. 8 is a vertical sectional view of a fourth embodiment of the present invention.

FIG. 8 shows an embodiment of the present invention mounted in line 60 which may be the best geometry for obtaining more than a 35% difference between mass flow rates in the heating and cooling cycles, using a single passageway The geometry employs a nozzle entrance 66 to short tube 62 in the cooling cycle and a protruding rim to form a lip portion 64 as an entrance in the heating cycle. Such an entrance, referred to as a re-entrant entrance, is more restrictive to fluid flow than a sharp-edged entrance, such as entrance 34 of FIG. 2.

Figure 3:
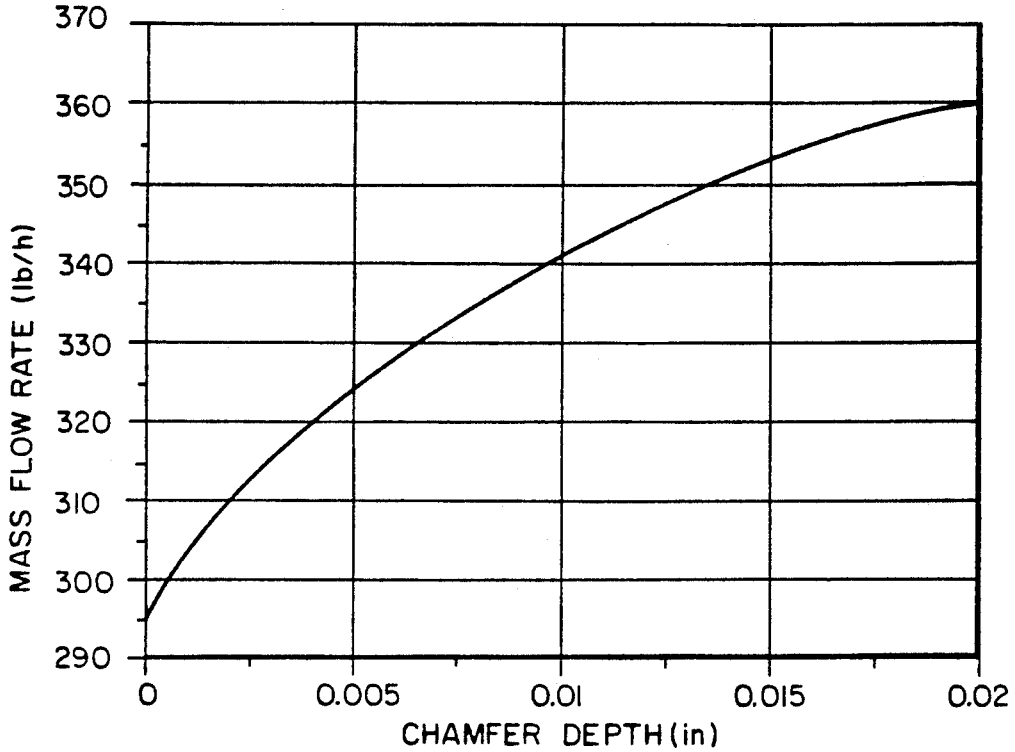
FIG. 3 is a graph showing the effect on the mass flow rate of refrigerant as a function of the inlet shape with constant outlet shape of the embodiment of FIG. 2.

FIG. 3 shows the dependency of the mass flow rate upon the configuration of the inlet chamfering. The length of tube 32 was 0.5 inches; the diameter of passage 38 was 0.053 inches; the chamfer angle was 45°; the upstream pressure was 250 psia; the downstream pressure was 91 psia; and, the subcooling was 25° F. All these parameters were kept constant while the inlet chamfer depth was varied.

Test results show that the mass flow rate of the refrigerant increased from about 295 pounds per hour for a sharp-edged entrance tube, i.e., no chamfer, to about 360 pounds per hour for a tube with a 0.02 inch depth of chamfer. Refrigerant mass flow rate in the opposite direction, i.e., with the 0.02 chamfer at the outlet, was found equal (within experimental uncertainty) to the mass flow rate of a short tube without any chamfer.

Other tests were run with an embodiment of FIG. 2 in which the short tube 32 was 1 inch long, and the chamfer depth was 0.25 inch, resulting in a chamfer angle of about 30°. The upstream pressure of the refrigerant was 250 psia, the downstream pressure 91 psia, and subcooling was 17.5° F. The mass flow rate for refrigerant flowing in the direction H was 241.9 pounds per hour, while the refrigerant flow rate in the direction of C was 311.1 pounds per hour. The mass flow rate of refrigerant in the direction C was 28.6% greater than that of refrigerant flowing in the direction H.

The embodiment of the present invention of FIG. 2 may be employed in a heat pump instead of two capillary tubes or two short tube restrictors and two associated check valves. There is a limitation in this embodiment in that the design mass flow rate difference between the cooling and heating modes must be less than about 35%. This difference is the maximum increase in mass flow rate that has been obtained by simply chamfering one side of a short tube and leaving the other side sharp-edged. It is theoretically possible to obtain a greater percent difference by utilizing a somewhat more complicated geometry, as shown in FIG. 8.

Figure 4:
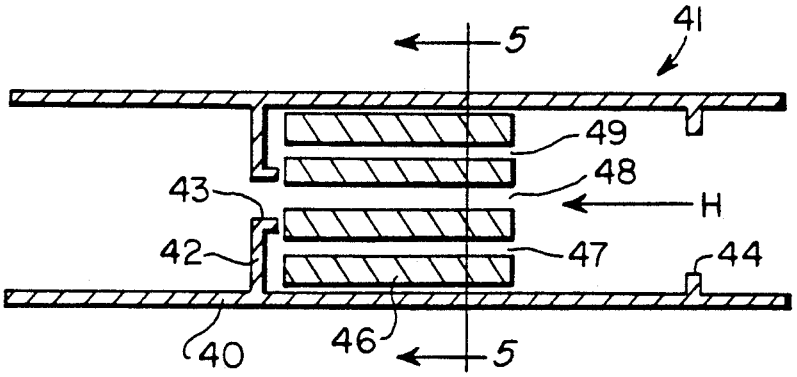
FIG. 4 is a vertical sectional view of a second embodiment of the present invention in a heating mode.
Figure 5:
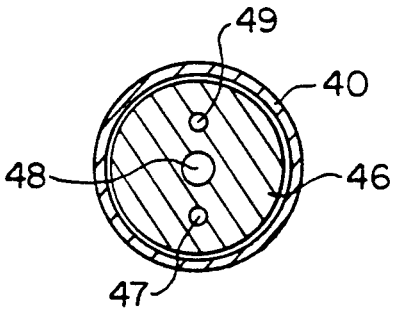
FIG. 5 is a vertical sectional view of the embodiment of FIG. 4 along the lines 5—5.
Figure 7:
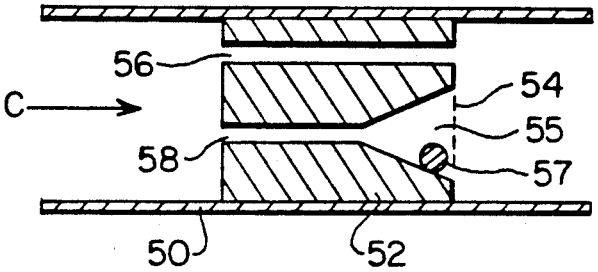
FIG. 7 is a vertical sectional view of a third embodiment of the present invention.

In other embodiments of the present invention, as shown in FIGS. 4, 5 and 7, different flow restrictions required for opposite flow directions are obtained by providing a short tube with a plurality of metering passages, all of which are used for refrigerant flow in the cooling mode and only a portion of which are used for refrigerant flow in the heating mode. As shown in FIGS. 4 and 5, short tube 46 having a plurality of passages 47, 48, 49 is slidably mounted in cage 41. Cage 41 is bounded by wall 40 of the refrigerant line and stops 44 and 42.

As shown in FIG. 4, the direction of flow of fluid for the heating cycle as indicated by the arrow has moved the short tube 46 to the left, where stop 42 having flange 43 blocks passages 47, 49. A reversal of the refrigerant flow will move short tube 46 to the right until it hits stop 44 in which position refrigerant can flow through all passages 47, 48 and 49.

Figure 6:
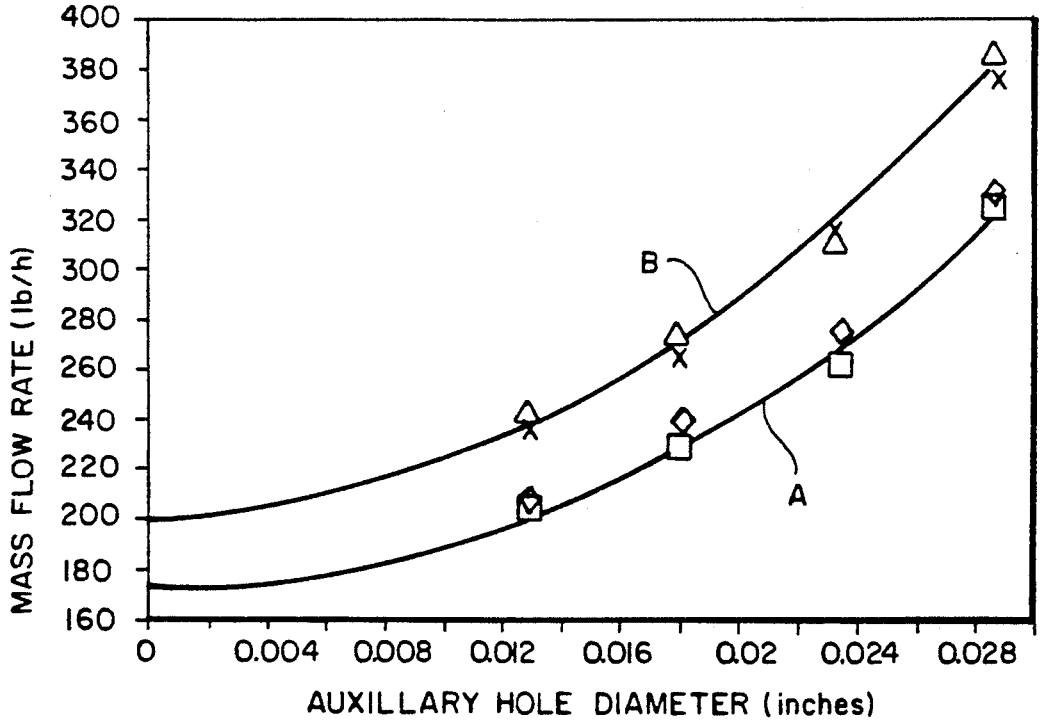
FIG. 6 is a graph showing the relationship between the diameter of auxiliary holes in the structure of FIGS. 4, 5 and the mass flow rate of refrigerant.

FIG. 6 is a graph showing the mass flow rate of refrigerant through the embodiment of FIG. 4 as a function of auxiliary hole diameter, i.e., holes 47, 49, where the main hole diameter has been maintained constant at 0.043 inches. For curve A, the upstream pressure was 250 psia, the downstream pressure was 91 psia and the upstream cooling was 17.5° F. The triangles represent measured values and the X's represent predicted values. For curve B, the upstream pressure was 290 psia, the downstream pressure was 91 psia and the upstream cooling was 25° F. The squares represent measured values and the diamonds represent predicted values.

The embodiment of FIGS. 4 and 5 has the advantage that it can be used for virtually any difference in required restrictiveness of the expansion device between the cooling and the heating modes, thus providing a range covering all mass flow rates and ratio of mass flow rates for heat pumps.

Another embodiment of the present invention is shown in FIG. 7 in which a short tube 52, provided with refrigerant flow passages 56, 58, is secured to the walls 50 of a refrigerant line. When refrigerant flows in the cooling mode in the direction of the arrows, refrigerant can flow through both passages 56 and 58. Upon reversal of the flow, spherical element 57, which is held in place in conical zone 55 by screen 54, is moved by the flowing refrigerant to block the entrance to passage 58, thus reducing the amount of refrigerant which can flow in the heating mode.

It is obvious that for the embodiments of both FIGS. 4 and 7 that the numbers and diameters of the passageways can be modified to meet any practical range of flows and flow differences.

The embodiments described herein are for the purpose of illustrating the present invention, and workers skilled in the art will recognize variations thereof that fall within the scope of this invention, which is limited only by the claims appended hereto and equivalent of the features described therein For example, the embodiment of FIG. 2 shows an expansion device in which the passageway has one defined by conical walls, while the other entrance is sharp-edged; however, it would be obvious to a worker skilled in the art that these walls could have other shapes such as having a curved cross-section, such as, for example, shown in FIG. 8. Similarly, while the embodiment of FIGS. 4 and 5 is shown as having two auxiliary passageways which are capable of being blocked during the heating mode, the number of auxiliary passages can be 1, 3, or 4 or more, depending on the design characteristics of the heat pump.

While the invention has been described in its application with a heat pump, it may be used with other apparatus in which fluid reverses its direction of flow and a different flow rate is required for each direction.

What is claimed is:

1. A bi-flow expansion device for refrigerant in a heat pump having a cooling mode in which refrigerant flows through said expansion device in a first direction, and a heating mode in which refrigerant flows through said device in a second direction, said expansion device comprising a tubular member having a first refrigerant entrance-exit means at a first end, said first entrance-exit means facing the direction from which refrigerant flows when said heat pump is in the cooling mode, a second refrigerant entrance-exit means at a second end, said second entrance-exit means facing the direction from which refrigerant flows when said heat pump is in the heating mode, at least one passage for refrigerant extending between said first and second entrance-exit means, and means for changing the rate of flow of refrigerant through said expansion device upon a change in direction of flow of refrigerant between said first and second entrance-exit means, said means for changing the rate of flow of refrigerant comprising a less obstructive opening to refrigerant flow at said first entrance-exit means than at said second entrance-exit means.

2. A bi-flow expansion device according to claim 1 wherein said entrance-exit means at the first end of said tubular member has a decreasing cross-sectional area in the direction toward said second end, and said second end comprises a sharp-edged entrance-exit.

3. A bi-flow expansion device according to claim 2 wherein said entrance-exit means at said first end is cone-shaped.

4. A bi-flow expansion device according to claim 2, wherein said entrance-exit means at said first end is in the form of a surface of revolution defined by rotating a curved line about an axis.

5. A bi-flow expansion device according to claim 1 wherein said entrance-exit means at the first end of said tubular member has a decreasing cross-sectional area in the direction toward said second end, and said second end comprises a re-entrant entrance-exit.

6. A bi-flow expansion device according to claim 5 wherein said entrance-exit means at said first end is cone-shaped.

* * * * *